United States Patent [19]

Ballinger

[11] 4,118,179

[45] Oct. 3, 1978

[54] MATERIAL PROCESSOR WITH RELATIVE MOVEMENT BETWEEN MATERIAL AND ITS POSITIONER

[75] Inventor: Dale O. Ballinger, Denver, Colo.

[73] Assignee: Honeywell Inc., Minneapolis, Minn.

[21] Appl. No.: 748,667

[22] Filed: Dec. 8, 1976

[51] Int. Cl.[2] ..... F27B 9/28

[52] U.S. Cl. ..... 432/59; 432/8; 68/5 R; 271/198; 226/171; 198/835; 34/120; 26/18.6

[58] Field of Search ..... 432/8, 59, 60; 219/216; 34/116, 118, 121, 120, 95; 271/198, 275; 226/170, 171; 68/5 D, 5 R; 198/835, 832, 813; 26/106, 18.6; 38/8-12

[56] References Cited

U.S. PATENT DOCUMENTS

| | | | |
|---|---|---|---|
| 1,837,408 | 12/1931 | Cluett | 26/18.6 |
| 1,861,422 | 5/1932 | Cluett | 26/18.6 |
| 2,332,296 | 10/1943 | Brunk | 34/120 |
| 2,413,339 | 12/1946 | Stadelman | 198/835 |
| 2,686,590 | 8/1954 | Sloane | 198/835 |
| 3,046,771 | 7/1962 | Bailey | 68/5 R |
| 3,349,222 | 10/1967 | Johnston | 432/59 |
| 3,374,769 | 3/1968 | Carlson | 432/60 |
| 3,740,867 | 6/1973 | Hamaguchi | 34/95 |
| 3,811,828 | 5/1974 | Ohta et al. | 432/59 |
| 3,847,705 | 11/1974 | Habert et al. | 38/12 |
| 3,938,261 | 2/1976 | Anderson | 34/155 |

FOREIGN PATENT DOCUMENTS

| | | | |
|---|---|---|---|
| 2,343,957 | 3/1975 | Fed. Rep. of Germany | 68/5 D |

*Primary Examiner*—Henry O. Yuen
*Attorney, Agent, or Firm*—Laurence J. Marhoefer; Lockwood D. Burton; George E. Bodenstein

[57] ABSTRACT

An elongatable endless belt passes around four rollers and, in so doing, passes adjacent to the heated surface of a U-shaped platen which has its edges adjacent to two of the rollers. The surface of the belt which faces the platen is in driving engagement with a film coming from a recording means. One of the noted two rollers is driven faster than the other so that the belt moves the film along the platen surface and leaves one edge of the latter at a higher speed than that at which the belt arrives at the other edge of the platen surface. Therefore, the belt progressively elongates and moves along the film as it is moving the latter along the platen surface.

12 Claims, 1 Drawing Figure

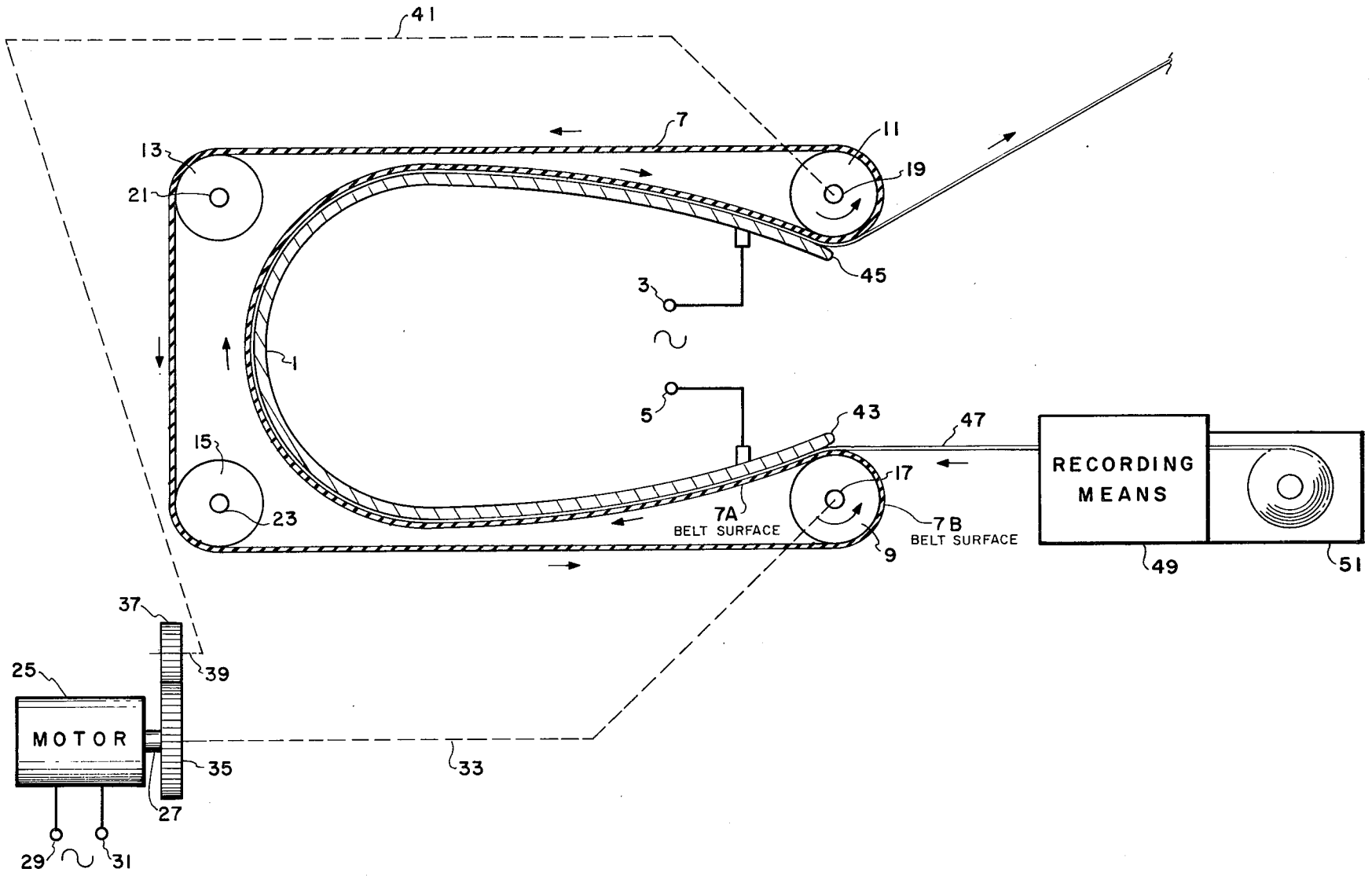
RECORDING MEANS
MOTOR
BELT SURFACE
BELT SURFACE
1
3
5
7
7A
7B
9
11
13
15
17
19
21
23
25
27
29
31
33
35
37
39
41
43
45
47
49
51

MATERIAL PROCESSOR WITH RELATIVE MOVEMENT BETWEEN MATERIAL AND ITS POSITIONER

BACKGROUND OF THE INVENTION

1. Field Of The Invention

The present invention relates generally to apparatus for subjecting material, such as sheet material, to a predetermined effect, which may be a processing effect, such as heat. Specifically, the invention relates to such apparatus wherein the material, which may be in short pieces or in long lengths, is appropriately positioned adjacent to an effect-producing means in order to cause the latter to subject the material to the predetermined effect. More specifically, the invention relates to that form of such apparatus wherein the noted positioning of the material adjacent to the effect-producing means is done by a material-positioning member which has a surface in contact with the material, and which, in the course of causing the material to be subjected to the desired effect, may simply hold the material stationary with respect to the effect-producing means, or may move the material relative to the effect-producing means.

2. Description Of The Prior Art

Apparatus of the type noted above, including a material-positioning member which contacts the material in positioning it so that it is subjected to the desired effect, is known and used extensively in numerous fields and applications. Such apparatus is known and used, for example, for drying, coating, shaping, developing, or otherwise processing, handling, or treating many different forms and types of materials.

One of the more extensive uses of such known apparatus is in the sheet material processing field, wherein the positioning member contacts the material to cause it to be subjected to the processing effect, and often also drives or conveys the material along or past the source of the processing effect in the course of the processing operation. Although the present invention is applicable to such apparatus in general, wherever the material is contacted by the positioning member while being exposed or subjected to the processing effect, the invention will be described herein with specific reference to that typical class or form of the known apparatus which is employed to process sheet material, and specifically to process long lengths of so-called heat-processed sheet material or film such as that which is used as the record medium in certain known recording instruments.

In a well known form of the typical apparatus last identified above, unprocessed film of the above-noted type bearing a recorded image or record passes into contact with the surface of a heated rotating drum. The film is positioned and held in contact with the drum by a shoe device so that the film moves with the drum and is subjected to the heat of the latter. This heat processes the film so that the record thereon is made permanently visible on the processed film which leaves the drum at the end of the processing procedure.

Although the known apparatus just described is capable of providing the noted processing action, said apparatus suffers from an inherent practical shortcoming. Specifically, it is known that optimum processing of such film requires that it be heated to a given temperature for a given length of time. This time may well be of the order of 30 seconds. For a typical speed of 1 inch per second for the recorded film arriving at the drum, the latter must thus have an effective heated surface length of the order of 30 inches. This requires that the drum have a diameter of the order of 10 inches. It is this requirement which constitutes the noted shortcoming of the known apparatus, since this requirement precludes the use of the apparatus as a part of a reasonably sized recording instrument.

In an effort to avoid the noted shortcoming of the above-described known apparatus, it has been proposed in the past to obtain the needed length of heated surface by the use of a folded heated platen, and to use a moving, endless, compliant belt as the positioning member to bring and maintain the film into processing contact with the platen. In this proposed arrangement, which is similar to the known arrangements employed for drying sheet material, the film bearing the record passes into contact with a contact surface of the belt, which then drives or conveys the film over, and in contact with, the heated platen surface. As before, the heat processes the film so that the record thereon is made permanently visible on the processed film which leaves the belt and the platen at the trailing end of the latter. This proposed arrangement has the practical advantage over the known drum type of apparatus described above of requiring significantly less space, inasmuch as the folded platen provides the needed length of heated surface in a significantly smaller space than that required when the same length of heated surface must be supplied by a drum.

Although the proposed belt and platen apparatus as just described is of a more practical and acceptable size with respect to the earlier described drum form of apparatus, the proposed belt and platen apparatus has been found to posses an even more series inherent shortcoming, which has made use of the proposed apparatus impractical. Specifically, it has been found that, in the use of this apparatus, the texture of the surface of the belt which contacts the film is transferred to, and appears permanently on, the film, and thus obliterates or at least degrades the record on the film. Such transfer of the belt surface texture or pattern to the film has been attributed to inherent unequal film pressure and thermal loading, which result in an unequal processing action. Consequently, it has not been possible to employ this proposed form of apparatus successfully.

SUMMARY OF THE INVENTION

Accordingly, it is an object of the present invention to provide improved apparatus of the above-noted type requiring a material-positioning member in contact with the material to cause the material to be subjected to the desired, predetermined effect, which improved apparatus, however, is not subject to the noted shortcomings possessed by the previously proposed and/or known forms of such apparatus. Specifically, it is an object of the invention to provide such improved apparatus which is of a convenient and practical size, but which prevents or at least minimizes the transfer to the material of the surface texture of the contacting material-positioning member. A more specific object of the invention is to provide such improved apparatus wherein the obliteration or degradation of a record on the material, as a result of the transfer to the material of the texture of the material-positioning member surface, is prevented or at least minimized.

To the end of accomplishing the above-noted and other desirable objects, the apparatus according to the present invention includes the noted member having a contact surface for contacting the material, and employs means which produce relative movement or motion between the member and the material while the latter is contacted by said contact surface and is subjected to the desired effect. Thus, in accordance with the invention, the noted means produce relative movement between the material and the member contact surface while these two are in contact. This relative movement effectively prevents, or at least minimizes, the transfer of the texture of the member contact surface to the material. Consequently, any degradation of a record on the material, due to the presence of the member and the action of its contact surface, is also minimized. This makes it both possible and practical to employ a platen form of apparatus as distinguished from the above-noted drum form, and thus to avoid the impractical size requirements imposed by the latter form without introducing the belt surface texture transfer problem of the previously proposed platen form of apparatus.

In the illustrated embodiment of the improved apparatus according to the invention, the noted desirable relative movement or motion between the positioning member contact surface and the material is obtained by elongating the member relative to the material while the latter is contacted by the contact surface of the member and is subjected to the predetermined effect. Also in this embodiment, this elongation and resulting relative movement are effected by drive means which also move the member relative to the effect-producing means and hence cause the contact surface of the member to move the material relative to the effect-producing means. Thus, said drive means both move the member and the material relative to the effect-producing means, and simultaneously move the member and its material-driving contact surface relative to the material.

Specifically, in said illustrated embodiment, the material is film, the effect-producing means is a heated platen surface, the material-positioning member is an elongatable endless belt having a surface in driving contact with the film to move it and to hold it on the platen surface, and the drive means move the belt so that it leaves the trailing edge or end of the platen surface at a higher speed than that at which the belt arrives at the leading edge or end of that surface. As a result, the belt both moves the film relative to the platen surface to cause the latter to heat the film, and also simultaneously elongates progressively so that its contact surface moves relative to the film to effect the noted minimization of the belt surface texture transfer to the film. Stated simply, as the belt moves itself and the film relative to the platen surface, the belt surface in contact with the film simultaneously moves relative to, or along, the film.

BRIEF DESCRIPTION OF THE DRAWING

A better understanding of the present invention may be had from the following detailed description when read in connection with the accompanying drawing, wherein the single FIGURE shows a belt and platen type of processing apparatus for heat-processed film embodying the present invention.

DETAILED DESCRIPTION OF THE PREFERRED EMBODIMENT

The apparatus shown in the drawing includes a belt and heated platen form of processing apparatus or processor which constitutes a preferred example of the above-described improved apparatus embodying the present invention. This illustrated processor is shown as cooperating with a recording means to heat-process or develop a heat-processed film type of record medium which the recording means passes to the processor after having placed on the film the form of record peculiar to that recording means.

In accordance with the foregoing brief description of the illustrated apparatus, the latter includes a folded, U-shaped platen 1. The platen 1 is considered to contain a suitable electric heating element which is energized by the connection of terminals 3 and 5 to a suitable source of electrical energy, such as an alternating current source. The platen 1 is also considered to include thermostatic controlling means for controlling the energization of the platen heating element so that the temperature of the outer surface of the platen is automatically maintained at a desired value as dictated by the nature of the film to be processed. Said heater and its controlling means, and the details of the platen construction, have not been and need not be shown in the drawing, since their specific form is not relevant to a proper understanding of the invention, and since platens provided with automatic temperature control are well known per se. The heated outer surface of the platen 1 will be referred to hereinafter simply as the platen surface.

Cooperating with the platen 1 is an elongatable endless belt 7 which constitutes the material-positioning member of the apparatus. The belt 7 is moved and guided along a predetermined path relative to the platen 1 and its surface by rollers 9, 11, 13, and 15. The rollers 9 and 11 are belt driving rollers, and are fixed on respective rotatable shafts 17 and 19. The rollers 13 and 15 are idler rollers, and rotate on or with respective shafts 21 and 23. All four of the rollers 9, 11, 13 and 15 are assumed to be of the same size.

Tracing the path or location of the belt 7 from the roller 9 in the illustrated apparatus, it is seen that the belt 7 passes around that roller, then over the surface of the platen 1, and then around the rollers 11, 13, and 15 and back to the roller 9. The belt 7 has a so-called outer surface 7A which is in driven engagement with the rollers 9 and 11, and has a so-called inner, film contacting and driving surface 7B which faces the platen surface where the belt is adjacent to that surface. Said film contacting and driving surface 7B of the belt 7 is suitably textured to enable that surface to perform its film-driving or moving function.

An electric motor 25 is employed to drive the rollers 9 and 11 and hence to move the belt 7 along its path relative to the platen 1. The motor 25 is arranged to produce rotation of an output shaft 27 when the terminals 29 and 31 of the motor are connected to a suitable source of electrical energy, such as an alternating current source. The shaft 27 drives or rotates the roller 9 in the indicated counter-clockwise direction through a mechanical linkage 33 which interconnects the motor shaft 27 and the roller shaft 17.

In accordance with the present invention, the roller 11 is made to rotate faster than the roller 9. To this end, the motor shaft 27 carries and rotates a gear 35. A smaller gear 37 is fixed on a shaft 39 and meshes with the gear 35. The resulting rotation of the gear 37 is imparted to the roller 11 through a mechanical linkage 41 which interconnects the gear shaft 39 with the roller shaft 19. The linkage 41 is so arranged that the roller 11 rotates in the illustrated counterclockwise direction.

Accordingly, both of the driven rollers 9 and 11 rotate in the same direction, with the roller 11 rotating at a higher speed than that of the roller 9 as determined by the diameter ratio of the gears 35 and 37.

It is assumed that, as a result of the construction described above, the rotation of the motor shaft 27 causes the belt 7 to move over and around the surface of the platen 1 in the illustrated clockwise direction. This makes the platen end or edge 43 which is adjacent to the roller 9 the leading edge of the platen 1, and makes the platen end or edge 45 which is adjacent to the roller 11 the trailing edge of the platen 1.

When the belt 7 is being driven and moved in the illustrated direction by the rotation of the motor shaft 27, any given point on the belt 7 leaving the roller 9 at the leading platen edge 43 moves around the platen 1, and leaves the latter at the trailing edge 45 of the platen. At this location, such a point moves onto the roller 11, from which it moves over the idler rollers 13 and 15 and back to and around the roller 9.

The above-mentioned film which is processed by the processing apparatus that has just been described is identified by the reference numeral 47, and is shown as coming from the above-mentioned recording means. The latter is identified by the reference numeral 49, and, as noted above, is arranged to place a record on the film 47 as the latter passes through the recording means.

As shown, the film 47 originates in a film supply chamber 51, from which it extends through the recording means 49 to the leading edge 43 of the platen 1. At this point, the film 47 passes into contact with the platen surface, passing between that surface and the film contacting and driving surface 7B of the belt 7. The surface 7B contacts or engages the film 47 and urges the latter into heat transfer contact with the platen surface throughout the length of that surface. This engagement of the film 47 by the surface 7B is also a film driving engagement, whereby the film 47 is moved over and along the platen surface by the movement of the belt 7 along its path. It has been found in practice that it is desirable to so orient the film 47 that its base or substrate surface contacts the platen surface, whereby the film emulsion surface is that which is engaged by the belt surface 7B.

OPERATION OF THE ILLUSTRATED APPARATUS

When the apparatus which has been described above is put into operation, the rotation of the motor shaft 27 rotates the rollers 9 and 11, which in turn engage the belt surface 7A and drive and move the belt 7 along its path in the illustrated direction. The film 47 is contacted by the contacting and driving surface 7B of the belt 7 throughout that portion of the film 47 which extends around the platen surface from the edge 43 to the edge 45. This contact causes the belt 7 to urge the film 47 into thermal or heat transfer contact with the platen surface, and causes the belt 7 to draw the film 47 from the recording means 49 and to drive and move the film 47 along and in contact with the platen surface. As a result, each increment of the film 47 is heated to a predetermined temperature for a predetermined length of time as is needed to effect the proper processing of the film.

Since the roller 11 rotates faster than does the roller 9, the belt 7 leaves the trailing edge 45 of the platen 1 at a higher speed than that at which the belt 7 arrives at the leading edge 43 of the platen. As a result, the belt 7 is progressively or gradually elongated or stretched as it travels with the film 47 which is on the platen surface between the edges 43 and 45. This elongation is progressive because of the frictional drag existing between the belt surface 7B and the film 47, and between the latter and the platen surface.

The noted progressive elongation of the belt 7 or, more particularly, of each increment thereof, starts when and where the belt 7 leaves the roller 9, and continues until the belt 7 seats on the faster turning roller 11. As the belt 7 leaves the latter, it contacts to its unelongated length.

The noted progressive elongation of the belt 7 causes it and its surface 7B to move relative to or along the film 47, which is relatively unstretchable. This movement of the belt 7 and its surface 7B along the film 47 continues while the latter is contacted by the surface 7B and is thereby urged into its heat receiving contact with the platen surface. Accordingly, as the belt 7 moves adjacent to the platen surface in contact with the film 47, the belt 7 moves the film 47 in contact with the platen surface, and simultaneously moves its own surface 7B along the film. As a result, there is little or no transfer of the texture or pattern of the belt surface 7B to the film 47, and little or no significant degradation of the record which is present on the film 47.

If desired, the above-described progressive elongation of the belt 7 can be obtained by driving the two rollers 9 and 11 at the same speed, and by making the roller 11 of a suitably larger diameter than the roller 9. Also, if desired, the gearing 35, 37 can be replaced by a second motor for driving the roller 11 at the desired higher speed than that at which the motor 25 drives the roller 9. Further, if desired, the motor 25 can be arranged to drive only the roller 11, and the desired progressive belt elongation obtained by suitably retarding or braking the roller 9.

By way of illustration and example, and not by way of limitation, it is noted that the elongatable belt 7 may be constructed of silicon foam, and that the film 47 may be Dry Silver film as produced by the 3M Corporation. When the requirements of the recording means 49 and its use are such that the film 47 can be drawn from the recording means 49 at a rate of the order of one inch per second, and when the film 47 which is used requires a heating time of the order of 30 seconds, the effective length of the platen surface is desirably made to be of the order of 30 inches.

In conclusion, it is believed to be clear from the foregoing description that the described processing apparatus according to the present invention fulfills the objects stated herein. Thus, it has been shown that such processing apparatus can be constructed to have such a small size as to make it suitable and practical for installation in the housing of a recording instrument of a practical size. It has also been shown that the belt in such apparatus can be prevented from transferring its pattern to the processed material by the use of means to produce movement of the belt on the material while these two are in contact and the material is being processed. It has been shown further that such movement can be readily achieved by progressively elongating the belt relative to the material while the processing operation is in progress.

The embodiments of the invention in which an exclusive property or privilege is claimed are defined as follows:

1. Processing apparatus for sheet material, comprising processing means having a processing surface, a belt having a driving surface arranged in driving contact with said material for conveying the latter over said processing surface when said belt is moved along a path adjacent to said processing surface, said belt tending to transfer the texture of said driving surface to said material when the latter is contacted by said driving surface, and means for moving said belt along said path so that said belt leaves said processing surface at a higher speed than that at which said belt arrives at said processing surface, and thus elongates progressively as it moves along said path, whereby said belt moves said material relative to said processing surface and simultaneously moves along said material to minimize the transfer of said texture of said driving surface to said material.

2. In processing apparatus wherein a belt has a driving surface which contacts sheet mateial for conveying the latter over a processing surface when said belt is moved along a path adjacent to said processing surface, said belt tending to transfer the texture of said driving surface to said material when the latter is contacted by said driving surface, the improvement comprising means for moving said belt along said path so that said belt leaves said processing surface at a higher speed than that at which said belt arrives at said processing surface, to cause said belt to elongate progressively and to move relative to said material as said belt conveys said material over said processing surface, thereby to minimize the transfer of said texture of said driving surface to said material.

3. Processing apparatus for sheet material, comprising processing means having a processing surface, an endless belt having a driving surface arranged in driving contact with said material for conveying the latter over said processing surface when said belt is moved along a path adjacent to said processing surface, said belt tending to transfer the texture of said driving surface to said material when the latter is contacted by said driving surface, and means for moving said belt along said path so that said belt leaves said processing surface at a higher speed than that at which said belt arrives at said processing surface, and thus elongates progressively as it moves along said path, whereby said belt moves said material relative to said processing surface and simultaneously moves along said material to minimize the transfer of said texture of said driving surface to said material.

4. Processing apparatus for sheet material, comprising processing means having a processing surface, first and second rotatable belt driving means located at opposite ends of said surface, an endless belt carried by said driving means and extending over said surface between said driving means, said belt having a driving surface arranged in driving contact with said material and tending to transfer the texture of said driving surface to said material when the latter is contacted by said driving surface, and drive means for rotating at least one of said driving means to cause the latter to move said belt over said processing surface, with said belt being moved away from said processing surface at a higher speed than the other of said driving means advances said belt toward said processing surface, whereby said belt moves said material relative to said processing surface and simultaneously elongated progressively and moves along said material to minimize the transfer of said texture of said driving surface to said material.

5. Processing apparatus for sheet material, comprising processing means having a processing surface provided with a leading edge and a trailing edge, a first rotatable belt driving means located adjacent to said leading edge of said surface, a second rotatable belt driving means located adjacent to said trailing edge of said surface, an endless belt in driven engagement with said driving means and extending over said surface between said driving means, said belt having a driving surface arranged to have driving contact with said material and to urge the latter into contact with said processing surface, said belt tending to transfer the texture of said driving surface to said material when the latter is contacted by said driving surface, and drive means for rotating said second driving means to cause said belt to move over said processing surface and to move away from said trailing edge thereof at a higher speed than that at which said belt arrives at said leading edge of said processing surface, whereby said belt moves said material relative to said processing surface and in contact therewith, and simultaneously elongates progressively and moves along said material to minimize the transfer of said texture of said driving surface to said material.

6. Apparatus as specified in claim 5, wherein said member is formed of a stretchable material and said sheet material is relatively unstretchable.

7. Apparatus as specified in claim 5, wherein said first driving means is a first roller, said second driving means is a second roller, and said drive means rotates said second roller at a higher speed than that at which said first roller rotates.

8. Apparatus as specified in claim 5, wherein said first driving means is a first roller, said second driving means is a second roller, and said drive means rotates said first roller at a speed which is lower than that at which said drive means rotates said second roller.

9. Apparatus as specified in claim 5, wherein said material is drawn from a supply thereof by said driving contact between said driving surface and said material.

10. Processing apparatus for a heat-processed record medium comprising a heated folded platen having a U-shaped surface provided with a leading edge and a trailing edge, a first rotatable belt driving roller located adjacent to said leading edge of said surface, a second rotatable belt driving roller located adjacent to said trailing edge of said surface, an elongatable endless belt in driven engagement with said rollers and extending over said surface between said rollers, said belt having a textured driving surface which faces said platen surface where said belt extends over said platen surface, drive means for rotating said second roller to move said belt along said platen surface with said driving surface in driving contact with said medium to draw the latter from a recording means for said medium and to move the latter along and in heat transfer contact with said platen surface, and means for causing said first roller to rotate at a speed which is lower than that at which said second roller rotates to cause said belt to elongate progressively while said driving surface is in contact with said medium, whereby said belt moves along said medium to minimize the transfer of the texture of said driving surface to said medium.

11. In processing apparatus wherein an endless belt has a driving surface which contacts sheet material for conveying the latter over a processing surface when said belt is moved along a path adjacent to said processing surface, said belt tending to transfer the texture of said driving surface to said material when the latter is contacted by said driving surface, the improvement comprising means for moving said belt along said path so that said belt leaves said processing surface at a higher speed than that at which said belt arrives at said processing surface, to cause said belt to elongate progressively and to move relative to said material as said belt conveys said material over said processing surface, thereby to minimize the transfer of said texture of said driving surface to said material.

12. In processing apparatus wherein an endless belt extends over a processing surface and has a driving surface which contacts sheet material and urges it against said processing surface, said belt also extending over a first rotatable belt driving means at the leading edge of said processing surface and over a second rotatable belt driving means at the trailing edge of said processing surface for causing said belt to move said material over and in contact with said processing surface when said driving means are rotated, said belt tending to transfer the texture of said driving surface to said material when the latter is contacted by said driving surface, the improvement comprising drive means for rotating said second driving means to cause said belt to move away from said trailing edge of said processing surface at a higher speed than that at which said belt arrives at said leading edge of said processing surface, to cause said belt to elongate progressively and to move relative to said material as said belt passes over said processing surface between said driving means, thereby to minimize the transfer of said texture of said driving surface to said material.

* * * * *